US005590919A

United States Patent [19]

Germano

[11] Patent Number: 5,590,919

[45] Date of Patent: Jan. 7, 1997

[54] T-ASTRAGAL AND SLEEVE FOR DOOR

[76] Inventor: John P. Germano, 13015 SW. 85th Ave., Miami, Fla. 33156

[21] Appl. No.: 373,114

[22] Filed: Jan. 17, 1995

[51] Int. Cl.[6] ..... E05C 1/02

[52] U.S. Cl. ..... 292/137; 292/340; 292/DIG. 21

[58] Field of Search ..... 292/137, DIG. 21, 292/340

[56] References Cited

U.S. PATENT DOCUMENTS

| | | | |
|---|---|---|---|
| 378,027 | 2/1888 | Volkerts . | |
| 1,079,047 | 11/1913 | Hoffman . | |
| 1,094,143 | 4/1914 | Hagstrom . | |
| 1,142,463 | 6/1915 | Shepherd | 292/DIG. 21 X |
| 1,190,439 | 7/1916 | Marchfield . | |
| 1,909,697 | 5/1933 | MacBeth et al. . | |
| 1,974,253 | 9/1934 | Sandor | 70/74 |
| 3,649,060 | 3/1972 | Ruff | 292/DIG. 21 X |
| 4,005,886 | 2/1977 | Lirette | 292/DIG. 21 X |
| 4,052,819 | 10/1977 | Beischel et al. | 49/368 |
| 4,315,647 | 2/1982 | Wilzig et al. | 292/DIG. 21 X |
| 4,470,276 | 9/1984 | Bayless | 70/91 |
| 5,005,881 | 4/1991 | Bailey et al. | 292/DIG. 21 X |
| 5,033,234 | 7/1991 | Simon et al. | 292/DIG. 21 |
| 5,076,620 | 12/1991 | Campbell et al. | 292/DIG. 21 X |
| 5,197,771 | 3/1993 | Kaup et al. | 292/DIG. 21 X |
| 5,350,207 | 9/1994 | Sanders | 292/335 |
| 5,382,060 | 1/1995 | O'Toole et al. | 292/46 |

*Primary Examiner*—Rodney M. Lindsey
*Assistant Examiner*—Monica E. Millner
*Attorney, Agent, or Firm*—Oltman Flynn & Kubler

[57] ABSTRACT

A novel t-astragal for use with double swinging doors such as for french doors is disclosed. The t-astragal includes a cap portion perpendicular to a base portion wherein both the cap and base can be formed from wood such as plywood or plastic. The t-astragal is a moulding that extends the full height of the swinging doors. One side of the base portion is fixably coupled to the free end of one of the swinging doors by nails or screws. The free end of the other swinging doors is able to swing up to and against a shoulder portion formed from the cap and base portions. A metal pipe shaped sleeve having an approximate length of one foot is partially positioned along the longitudinal axis of the t-astragal molding. A bolt slides within the sleeve from a rest position to an extended position, where the extended position locks the attached door to a matching slot in the door frame.

16 Claims, 2 Drawing Sheets

FIG. 3
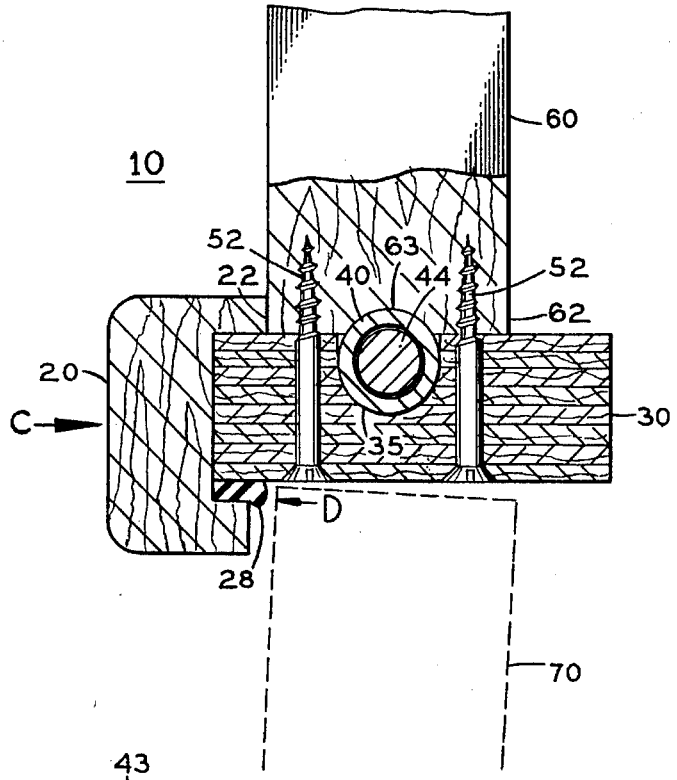
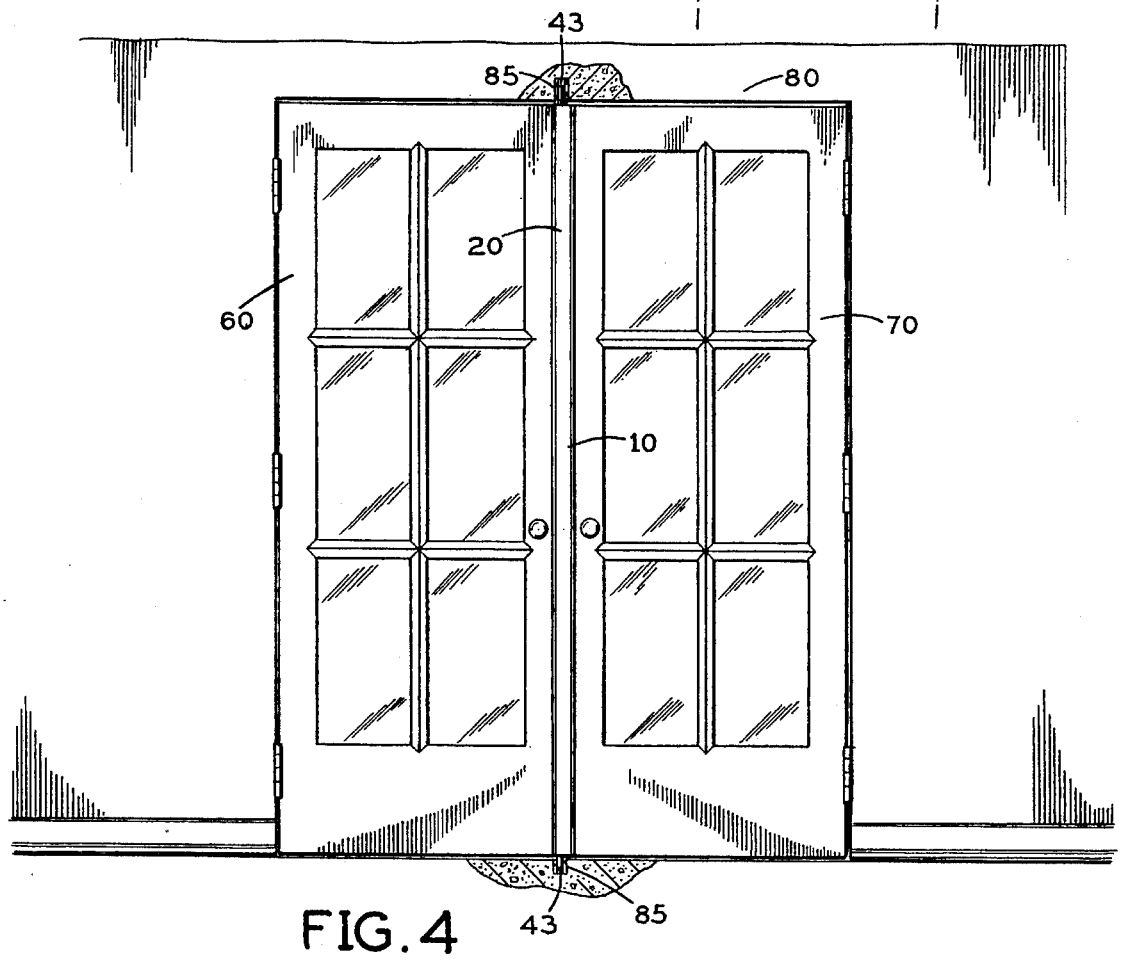
FIG. 4

T-ASTRAGAL AND SLEEVE FOR DOOR

This invention relates to weather and door strips, and in particular to a novel t-astragal for use with protecting and preventing double swinging doors from opening during storms.

BACKGROUND AND PRIOR ART

T-astragals have been used extensively for exterior type french doors which are often called double swinging doors. The t-astragal is used as both a weather stripping for the space between double swinging doors and as a lock to hold one of the doors in place in order for the other door to close onto. The weather stripping factor in these t-astragals has generally been effective in preventing light rain and light air drafts from passing through the space between the swinging doors. Sliding levers in the door attached to the t-astragal are often located on the inside portion of the door and work as a lock for preventing at least the one door with the t-astragal from being opened from the outside exterior side of the door. The sliding levers in the prior art t-astragals often slide a lever within a wood slot opening. See for example, U.S. Pat. No. 1,094,143 to Hagstrom and U.S. Pat. No. 1,974,253 to Sandor which are incorporated by reference.

However, recent storms such as Tropical Storm Gordon and Hurricane Andrew have shown that these old t-astragal designs do not hold up to winds and rains of 25 mph or more, where the wind pressure is at least 1.57 pounds per square foot. Extreme weather conditions can often have air and water striking the sides of buildings at 50 mph, 75 mph, 110 mph and higher. Flying debris during these storms can further pummel the sides of the buildings with additional pressure. The prior art t-astragals are not able to keep the double doors closed under these extreme weather conditions. Often the metal lever components in the t-astragal can splinter the wood along the door jamb further adding flying debris during a storm that can further cause damage inside of the building.

Thus, the need exists for adequately and safely preventing double swinging doors from opening during storm conditions.

SUMMARY OF THE INVENTION

The first objective of the present invention is to provide a t-astragal for preventing swinging doors from opening during high winds.

The second object of this invention is to provide a t-astragal for preventing swinging doors from opening during rain storms.

The third object of this invention is to provide a t-astragal for preventing swinging doors from opening during extreme storm conditions.

The fourth object of this invention is to provide a t-astragal that does not splinter a door during extreme storm conditions.

The fifth object of this invention is to provide a t-astragal moulding for use with french doors.

A preferred embodiment of the t-astragal moulding is for attachment to the free end of one of the swinging doors found in a set of french doors. The french doors include a first door having a first side edge and a second side edge, the first side edge capable to swing and pivot about the second side edge from an open position to a closed position. The french doors further include a second door having a first side edge and a second side edge, the first side edge capable to swing and pivot about the second side edge from an open position to a closed position, wherein the first side edge of each door swings toward the other door. The t-astragal moulding includes a cap portion perpendicular to a base portion, the cap portion forming a first shoulder and a second shoulder about opposite sides of the base portion, the first shoulder abuting against and adjacent to the first side edge of the first door. The t-astragal further includes a metal sleeve in the moulding with a bolt slidably located in the sleeve, the bolt having an initial position and an extended position, wherein pushing the bolt from the initial position into the extended position when the first door is in the closed position prevents the first door from swinging. The cap and base are formed from either wood or plastic. The metal sleeve is a pipe shape of approximately one foot in length having a first end and a second end, the first end located adjacent to the top of the first door or alternatively has the first end located adjacent to the bottom of the first door. The metal sleeve can be partially positioned in a slot formed between the moulding and the first side edge of the first door. The t-astragal moulding can also be used for swinging window doors.

Further objects and advantages of this invention will be apparent from the following detailed description of a presently preferred embodiment which is illustrated schematically in the accompanying drawings.

BRIEF DESCRIPTION OF THE FIGURES

FIG. 3 shows a top cross-sectional view of the t-astragal invention of FIG. 1 along arrow B fixably attached to the free end of a swinging door.

FIG. 4 shows a frontal view of the t-astragal invention of FIG. 3 along arrow C with both of the swinging doors in a closed position.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
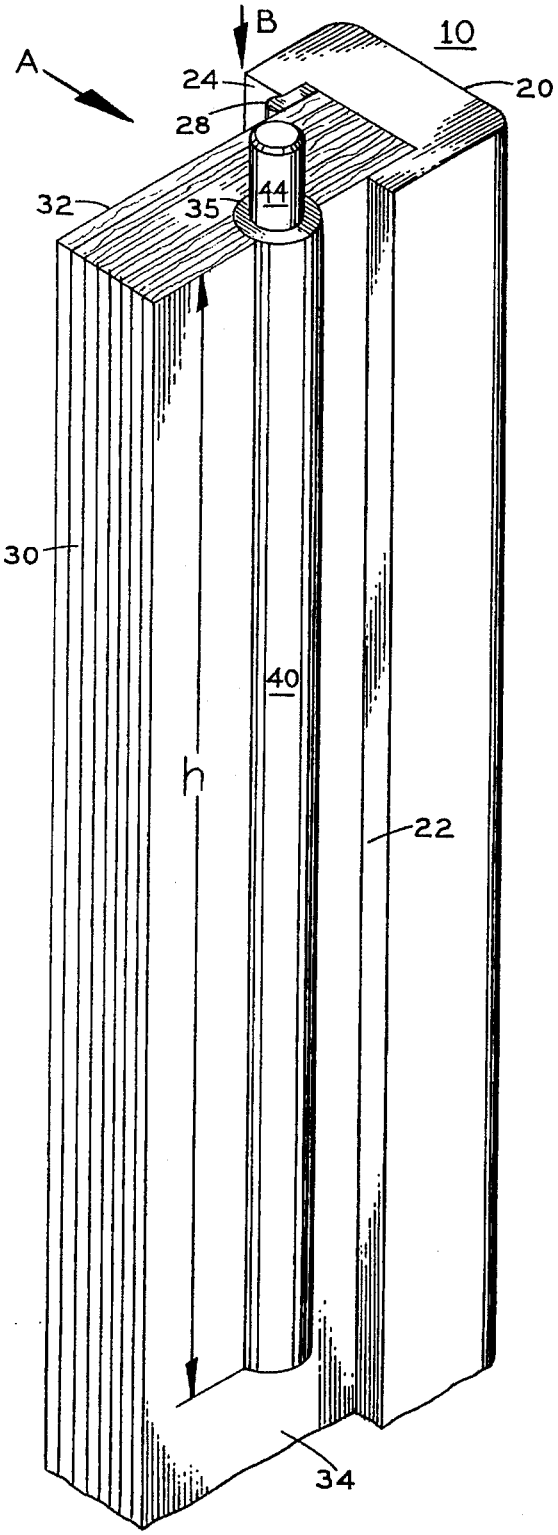
FIG. 1 shows a perspective view of the base, sleeve and cap portions of the t-astragal invention.

FIG. 1 shows a perspective view of the base 30, sleeve 40 and cap 20 of the t-astragal invention 10. The components of the invention 10 will now be described. Base 30 and cap 20 can be formed from wood such as but not limited to plywood or alternatively a reinforced plastic such as but not limited to fiberglass and the like. Cap 20 further includes a gasket 28 that runs along the longitudinal axis along one shoulder 24 of cap 20. Gasket 28 can be a weather type strip material such as but not limited to elastomer rubber, nylon and the like. Shoulder 24 sealably abuts against free moving door and side 34 of base 30 is fixably attached to the free end of the other swinging door, both which are shown and described in reference to FIGS. 3 and 4. Referring back to FIG. 1, pipe sleeve 40 formed from metal such as galvanized steel, aluminum, stainless steel and the like, is positioned within a slot 35 formed in side 34 of base 30. Pipe sleeve 40 can have an approximate length, h of approximately one foot, have an inner diameter inside the sleeve of approximately 17/32 to 33/64 of an inch and an outer diameter of approximately 11/16 of an inch. Inside pipe sleeve 40 is a bolt 44 formed of metal such as galvanized steel, aluminum, stainless steel and the like, which is slidably movable from a rest position completely within the sleeve 40, to an extended position with the outer end 43 for locking into a matching slot 85 in the door frame 80 above the swinging door, shown in FIG. 4. This slot 85 can have a metal cylindrical housing and the like for lockably securing the door in place.

Figure 2:
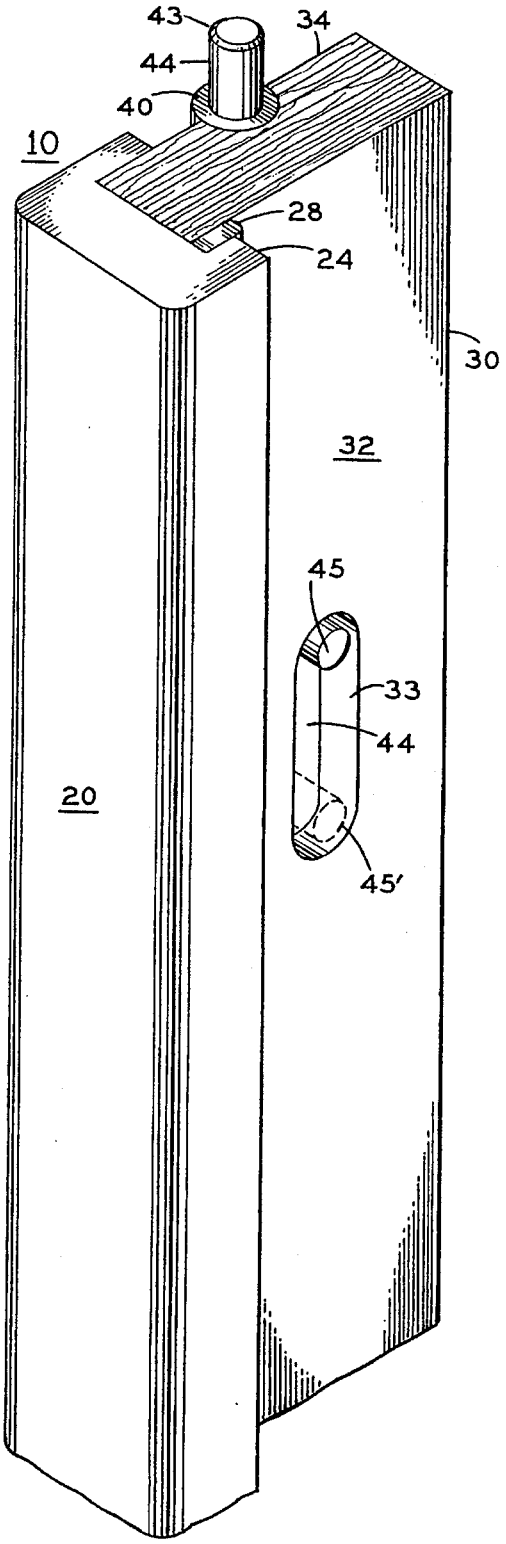
FIG. 2 shows a view of the t-astragal invention along arrow A.

FIG. 2 shows a view of the t-astragal invention 10 of FIG. 1 along arrow A. Here, side opening 33 in the side 32 of base 30 is more clearly shown. Bolt 44 is slidably movable by a raised handle/lever portion 45 attached to or formed into the side of bolt 44. Handle/lever portion 45 can be moved to position 45' which would lower the bolt totally within the sleeve. Moving handle/lever to position 45 exposes end 43 of bolt 44.

FIG. 3 shows a top cross-sectional view of the t-astragal invention of FIG. 1 along arrow B fixably attached to the free end 62 of a swinging door 60 by fasteners 52 such as nails, screws and like. Sleeve pipe 40 can be inserted half into a slot 63 formed in free end 62 of door 60 and half into a slot 35 formed in base 30. Element 70 refers to the unattached swinging door 70 which moves in the direction of arrow D which will eventually abut up against weather strip 28.

FIG. 4 shows a frontal view of the t-astragal invention of FIG. 3 along arrow C with both of the swinging doors 60 and 70 in a closed position. Referring to FIG. 4 double swinging doors 60,70 that can include glass panel(s) french doors and the like are mounted in door frame 80. In the closed position, end 43 of bolt 44 is locked into matching housing slot 85 which is formed in frame 80. The novel t-astragal can be used with either in-swinging and outswinging double doors.

While the preferred embodiment has been described for use with double swinging doors, the invention would have applicability to double swinging windows. The T-astragal can have various front face designs.

While the preferred embodiment has been described for exterior type swinging doors, the invention can also be used with interior type french doors.

Although the novel t-astragal invention is described as inserting the metal sleeve portion into the top of a swinging door, the metal sleeve can also be alternatively be located in the lower portion of the swinging door for locking the door to the base of the door frame. Further, metal sleeves with respective bolts can also be located in both the upper and lower locations of a single door as needed.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A locking t-astragal moulding assembly comprising:

a first door having a first side edge and a second side edge, the first side edge having a door edge channel and said first side edge being capable to swing and pivot about the second side edge from an open position to a closed position;

a second door having a first side edge and a second side edge, the first side edge capable to swing and pivot about the second side edge from an open position to a closed position, wherein the first side edge of each door swings toward the other door;

a moulding having a front portion and a rear portion, the front portion having a moulding front portion channel and being fixably attached to the first side edge of the first door to form a joint between the door first side edge and the moulding front portion;

a metal sleeve in the moulding mounted partially within said door edge channel and partially within said moulding front portion channel such that said metal sleeve reinforces said joint between the first door first side edge and the moulding front portion against separation in shear;

a bolt slidably located in the sleeve, the bolt having an initial position and an extended position, wherein pushing the bolt from the initial position into the extended position when the first door is in the closed position prevents the first door from swinging.

2. The locking t-astragal moulding assembly of claim 1, wherein the first door and the second door are:

french doors.

3. The locking t-astragal moulding assembly of claim 1, the moulding further includes:

a cap perpendicular to a base, the cap romping a first shoulder and a second shoulder about opposite sides of the base, the first shoulder abuting against and adjacent to the first side edge of the first door.

4. The locking t-astragal moulding assembly of claim 3, wherein the cap and base are formed from:

wood.

5. The locking t-astragal moulding assembly of claim 3, wherein the cap and base are formed from:

plastic.

6. The locking t-astragal moulding assembly of claim 1, the metal sleeve further including:

a pipe shape having a first end and a second end, the first end located adjacent to the top of the first door.

7. The locking t-astragal moulding assembly of claim 1, the metal sleeve further including:

a pipe shape having a first end and a second end, the first end located adjacent to the bottom of the first door.

8. The locking t-astragal moulding assembly of claim 1, the metal sleeve further including a length of:

approximately one foot.

9. The locking t-astragal moulding assembly of claim 1, wherein the first door and the second door are:

swinging double window doors.

10. A locking t-astragal moulding assembly comprising:

a swinging door having a first side edge and a second side edge, the first side edge having a door edge channel and said first side edge being capable to swing and pivot about the second side edge from an open position to a closed position;

a moulding having a front portion and a rear portion, the front portion having a moulding front portion channel and being fixably attached to a free end of a swinging door to form a joint between the door first side edge and the moulding front portion;

a metal sleeve in the moulding mounted partially within said door edge channel and partially within said moulding front portion channel such that said metal sleeve reinforces said joint between the door first side edge and the moulding front portion against separation in shear;

a bolt slidably located in the sleeve, the bolt having an initial position and an extended position, wherein pushing the bolt from the initial position into the extended position prevents the door from swinging.

11. The locking t-astragal moulding assembly of claim 10, further including:

a second door having a free end capable of swinging toward a position adjacent to the free end of the first swinging door.

12. The locking t-astragal moulding assembly of claim 10, the moulding further includes:

a cap perpendicular to a base, the cap forming a first shoulder and a second shoulder about opposite sides of the base, the first shoulder abuting against and adjacent to the free end of the door.

13. The locking t-astragal moulding assembly of claim 12, wherein the cap and base are formed from:

wood.

14. The locking t-astragal moulding assembly of claim 12, wherein the cap and base are formed from:

plastic.

15. The locking t-astragal moulding assembly of claim 10, the metal sleeve further including:

a pipe shape having a first end and a second end, the first end located adjacent to the top of the door.

16. The locking t-astragal moulding assembly of claim 10, the metal sleeve further including:

a pipe shape having a first end and a second end, the first end located adjacent to the bottom of the door.

* * * * *